US007736703B1

(12) United States Patent
Schofield et al.

(10) Patent No.: US 7,736,703 B1
(45) Date of Patent: Jun. 15, 2010

(54) METHOD OF MAKING AN ARTIFICIAL HOLLOW CORE BOULDER FILLED WITH NON-BIODEGRADABLE WASTE

(76) Inventors: John Paul Schofield, 1847 Terrence Dr., Stafford, TX (US) 77477; Janet Ellen Schofield, 1847 Terrence Dr., Stafford, TX (US) 77477

( * ) Notice: Subject to any disclaimer, the term of this patent is extended or adjusted under 35 U.S.C. 154(b) by 0 days.

(21) Appl. No.: 12/378,557

(22) Filed: Feb. 17, 2009

Related U.S. Application Data

(60) Provisional application No. 61/066,627, filed on Feb. 22, 2008.

(51) Int. Cl.
*B05D 5/00* (2006.01)
*B05D 1/36* (2006.01)
*E04B 1/00* (2006.01)

(52) U.S. Cl. ..... 427/403; 427/407.1

(58) Field of Classification Search ..... 427/402, 427/403, 407.1; 52/DIG. 9
See application file for complete search history.

(56) References Cited

U.S. PATENT DOCUMENTS 1,776,999 A * 9/1930 Jensen ..... 249/114.1
3,924,037 A 12/1975 Sullivan
3,950,477 A 4/1976 Di Giacomo
4,043,826 A 8/1977 Hum
4,197,684 A 4/1980 Johnson
4,385,088 A 5/1983 Baskin
4,531,635 A 7/1985 Cleveland
4,668,451 A 5/1987 Langson
4,754,852 A * 7/1988 Mule et al. ..... 181/149
4,758,934 A 7/1988 von Kohorn
4,960,622 A 10/1990 Jarboe et al.
5,195,638 A * 3/1993 Zinbarg ..... 206/457
5,211,996 A * 5/1993 Zinbarg ..... 428/16
5,213,854 A 5/1993 Williams et al.
5,214,897 A 6/1993 Nordberg
5,240,528 A 8/1993 Pagni
5,268,226 A 12/1993 Sweeney (Continued)

FOREIGN PATENT DOCUMENTS

JP 2002-234038 A * 8/2002

OTHER PUBLICATIONS

"Stucco" from http://www.merriam-webster.com/dictionary/stucco; retrieved Dec. 1, 2009; 2 pages.*

(Continued)

*Primary Examiner*—William Phillip Fletcher, III

(57) ABSTRACT

An artificial hollow core boulder and method of fabrication. A plastic trash bag is loosely filled with newspaper, tied shut, and wrapped with a layer of chicken wire. The chicken wire wrapped bag is hand pressed into a boulder like shape and a hole is cut into the chicken wire at the bottom of the wrapped bag. Wet stucco mix is troweled over the chicken wire and the wire is lightly pulled away from the plastic. A second layer of stucco mix is troweled over the dried first layer of stucco. A hole is cut in the plastic bag through the hole in the chicken wire and the newspapers are removed. The hollow core artificial boulder is filled through the hole with expended, crushed, cans and plastic bottles. The hole is sealed with chicken wire and stucco. The completed boulder is sealed with penetrating acid stain or latex stain.

2 Claims, 3 Drawing Sheets

U.S. PATENT DOCUMENTS

| | | | | | |
|---|---|---|---|---|---|
| 5,275,852 | A | | 1/1994 | Jones et al. | |
| 5,285,898 | A | * | 2/1994 | Zinbarg et al. | 206/457 |
| 5,332,605 | A | | 7/1994 | DeLamar | |
| 5,395,577 | A | * | 3/1995 | Gorski | 264/227 |
| 5,435,949 | A | * | 7/1995 | Hwang | 264/51 |
| 5,458,932 | A | * | 10/1995 | Zinbarg et al. | 428/16 |
| 5,543,100 | A | | 8/1996 | Kluh et al. | |
| 5,714,211 | A | * | 2/1998 | Zinbarg et al. | 428/16 |
| 5,733,170 | A | * | 3/1998 | Wotton | 446/385 |
| 5,826,373 | A | | 10/1998 | Mrdjenovich | |
| 5,888,596 | A | * | 3/1999 | Zinbarg et al. | 428/16 |
| 5,911,927 | A | | 6/1999 | Roberts | |
| 5,989,095 | A | * | 11/1999 | Wotton | 446/385 |
| 6,001,434 | A | * | 12/1999 | Zinbarg et al. | 428/16 |
| 6,033,744 | A | | 3/2000 | Bright, Sr. | |
| 6,132,820 | A | | 10/2000 | Callahan | |
| 6,163,933 | A | * | 12/2000 | Smith | 24/66.2 |
| 6,248,411 | B1 | | 6/2001 | Warfel | |
| 6,409,359 | B1 | | 6/2002 | O'Connell | |
| 6,581,349 | B1 | * | 6/2003 | Riley | 52/454 |
| 6,623,813 | B2 | | 9/2003 | Hsu | |
| 6,851,228 | B1 | * | 2/2005 | Forman | 52/81.2 |

OTHER PUBLICATIONS

"Fake Boulders;" http://www.koiphen.com/forums/showthread.php?t=80104; article posted Sep. 2004; retrieved Dec. 1, 2009; 8 pages.*

Jun. 5, 2008, version of "How to Make a Fake Rock;" http://www.ehow.com/how_2252642_make-fake-rock.html, retrieved Dec. 1, 2009, from http://web.archive.org/web/20080605103240/http://www.ehow.com/how_2252642_make-fake-rock.html; 2 pages.*

"How do you make fake rocks?" http://answers.yahoo.com/question/index?qid=20090703223333AA3wubX; article posted Jul. 3, 2009; retrieved Dec. 1, 2009; 3 pages.*

Machine translation of JP 2002-234038 A, generated Feb. 23, 2010, 10 pgs.*

* cited by examiner

STEP 1: LOOSELY FILL A PLASTIC TRASH BAG WITH CRUMPLED NEWSPAPER AND TIE THE BAG SHUT.

STEP 2: WRAP THE FILLED BAG WITH ONE LAYER OF CHICKEN WIRE.

STEP 3: PRESS VARIOUS PARTS OF THE WRAPPED BAG BY HAND TO MOLD INTO A BOULDER SHAPE.

STEP 4: CUT A HOLE APPROXIMATELY 5" BY 5" IN THE CHICKEN WIRE AT THE BOTTOM OF THE WRAPPED, BOULDER SHAPPED BAG.

STEP 5: TROWEL WET STUCCO MIX OVER THE CHICKEN WIRE, EXCEPT WHERE THE HOLE IN THE CHICKEN WIRE IS LOCATED.

STEP 6: LIGHTLY PULL THE CHICKEN WIRE AWAY FROM THE PLASTIC.

STEP 7: TROWEL A SECOND LAYER OF STUCCO MIX OVER THE FIRST LAYER OF STUCCO WHICH HAS DRIED.

STEP 8: CUT A HOLE IN THE PLASTIC BAG THROUGH THE HOLE IN THE CHICKEN WIRE AND REMOVE THE NEWSPAPERS.

STEP 9: FILL THE HOLLOW BOULDER THROUGH THE HOLE IN THE PLASTIC BAG WITH EXPENDED, CRUSHED, CANS AND PLASTIC BOTTLES.

STEP 10: SEAL THE HOLE WITH CHICKEN WIRE AND STUCCO.

STEP 11: SEAL THE COMPLETED BOULDER WITH A PENETRATING ACID STAIN OR AN ENVIRONMENTALLY FRIENDLY LATEX STAIN.

FIG 5

METHOD OF MAKING AN ARTIFICIAL HOLLOW CORE BOULDER FILLED WITH NON-BIODEGRADABLE WASTE

CROSS-REFERENCE TO RELATED APPLICATIONS

This application claims the benefit of provisional patent application Ser. No. 61/066,627, filed Feb. 22, 2008 by the present inventors.

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to artificial boulders and specifically to a method of making artificial hollow core boulders and rocks using a large percentage of expended materials.

2. Prior Art

Boulders and rocks have long been used in landscaping for aesthetic purposes, such as to provide a natural effect, to highlight certain areas and to enhance the beauty of the areas. And the use of artificial boulders for aesthetic purposes is well known in the prior art.

Currently, many people are concerned with recycling and with the environment.

The present invention provides an artificial hollow core boulder or rock that is aesthetically pleasing, easy and economical to make, and can be manufactured locally. It also provides for the use of materials that would otherwise be waste and go into already overcrowded landfills.

Previously, artificial hollow rocks and boulders have been made using a mold, thus increasing manufacturing expense, and the method of their manufacture has not addressed recycling.

U.S. Pat. No. 5,543,100 (1996), to Kluh and Precht proposes to manufacture large scale artificial rocks from plastic reproductions. This would involve having to go to the sites to get the molds for the reproductions, and it does not address recycling.

U.S. Pat. No. 5,911,927 (1999), to Roberts proposes a method of producing artificial rock formations using flexible molds of latex. This entails having to first make master models, then to make the actual molds, and does not address recycling.

U.S. Pat. No. 6,248,411 B1 (2001), to Warfel proposes a hollow decorative rock product that is made from a mold and is basically a shell that can be used to cover outside items such as utility boxes. Again, this requires that a mold be made before the rock can be constructed. Also, there is little similarity between this rock and its method of manufacture and the present invention.

U.S. Pat. No. 6,033,744 (2000), to Bright, Sr. proposes a rock shell formed to resemble a boulder. The exterior surface has an aperture into the cavity, which can be filled with ballast. This invention does not address recycling. Again, it has little similarity in its method of manufacture to the present invention.

U.S. Pat. No. 6,409,359 B1 (2002), to O'Connell proposes a rock shell, shaped and colored like a rock with a hollow interior for a light source. Again, this invention does not address recycling, and this rock differs significantly from the rock of the present invention and its method of manufacture.

The current inventors could find no method in the prior art of making a hollow core artificial boulder or rock that was similar to the method of our invention.

OBJECTS AND ADVANTAGES

Accordingly, several objects of our invention are to provide a novel way of producing an aesthetically pleasing, hollow, artificial boulder or rock that looks just like a real rock or boulder without using a mold. Because a mold is not required, the time needed to manufacture the product is significantly decreased.

Another object is to produce the artificial boulder at a relatively low cost. Again, because a mold is not needed, cost is decreased. Also, the materials used to make the product are relatively inexpensive.

A further object is that the artificial boulder or rock can be made locally. The manufacturer does not have to go to an outside site to obtain a reproduction, and the materials used to produce the current proposed invention are all locally and readily available.

A still further object is that the artificial hollow boulder or rock can provide for the recycling of some inorganic, non-biodegradable, waste materials.

Further objects and advantages will become apparent from the ensuing description and drawings.

SUMMARY

The present invention pertains to a novel method of making a simulated, hollow core boulder or rock and the boulder thus produced.

In accordance, the method comprises first loosely filling a plastic trash bag with newspaper and tying it shut. In the preferred embodiment, herein depicted and described, crumpled newspaper is used to fill the plastic trash bag. However, the bag could also be loosely filled with, including but not limited to hay, used soft sponges, used soft rags, used soft foam, or used cut-up pillows. The plastic bag can be any standard size, depending on the desired size of the rock or boulder. In the herein depicted embodiment, a 13-gallon kitchen trash bag is used. The newspaper filled, plastic bag is then covered with one layer of chicken wire. The chicken wire covered bag is malleable and is pressed on at various parts to form a boulder shape. A hole is then cut in the chicken wire of the filled, wrapped, plastic bag, where the bottom of the boulder will be. Stucco mix is troweled over the chicken wire, except over the hole. The chicken wire is lightly pulled away from the plastic so that it is in the middle of the stucco layer. After the stucco has dried, a second layer is troweled over the first layer. A hole is cut into the plastic bag from where the hole in the chicken wire is located and the newspapers are removed. In the preferred embodiment the hollow rock or boulder is now filled with expended and crushed, cans and plastic bottles. The hollow rock or boulder can be left unfilled if desired for a lower shipping weight. Or the hollow rock or boulder can be filled with expended, plastic, grocery bags for a lighter weight that still addresses recycling advantages. The hole is then sealed with chicken wire and stucco.

The completed boulder is now sealed with a penetrating acid stain. In the preferred embodiment, an environmentally friendly latex stain is used.

BRIEF DESCRIPTION OF THE DRAWINGS

FIG. 5 is a flow chart showing in a general way the steps of the method of producing the artificial hollow core boulder.

DETAILED DESCRIPTION ACCORDING TO THE PREFERRED EMBODIMENTS OF THE PRESENT INVENTION

Figure 1:
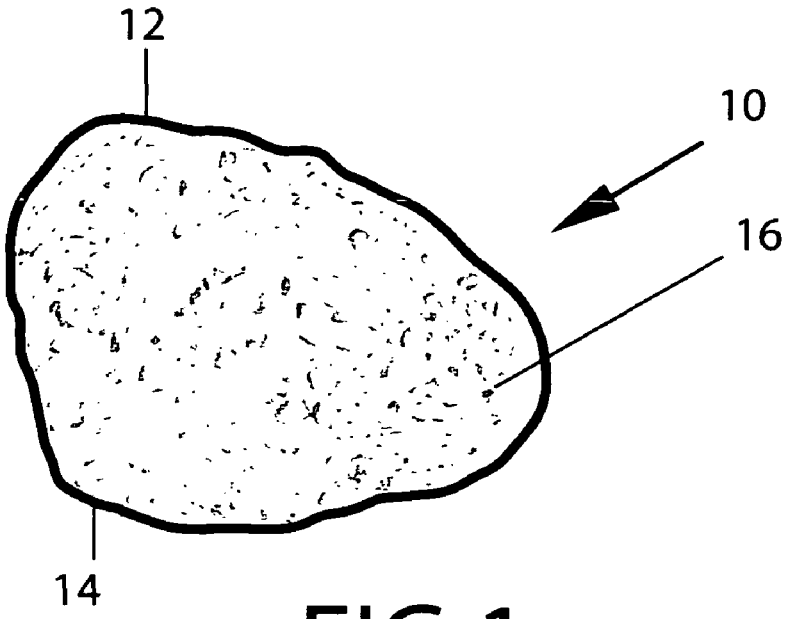
FIG. 1 is an elevational side view of the artificial hollow core boulder according to our invention.

FIG. 1 shows a preferred embodiment of the artificial hollow core boulder 10 of the present invention, which has a stucco surface 16. The boulder 10 is shown right side up, with the top of the boulder 12 at the top and the bottom of the boulder 14 on the bottom.

Figure 2:
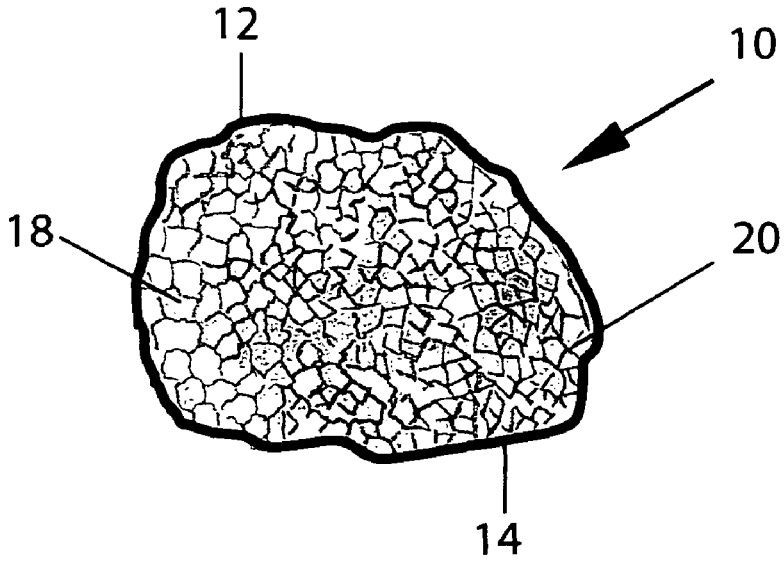
FIG. 2 is an elevational side view of the newspaper filled and chicken wire wrapped plastic bag according to our invention.

Illustrated in FIG. 2 a plastic bag 18 is loosely filled with crumpled newspaper, (not shown), and tied shut. The bag is not packed too tightly with the newspaper so as not to be too stiff. The filled bag 18 is wrapped with a layer of chicken wire 20. The bag is malleable and pressed at several places by hand (not shown) to have a boulder shape as described in Step 3 of FIG. 5.

Figure 3:
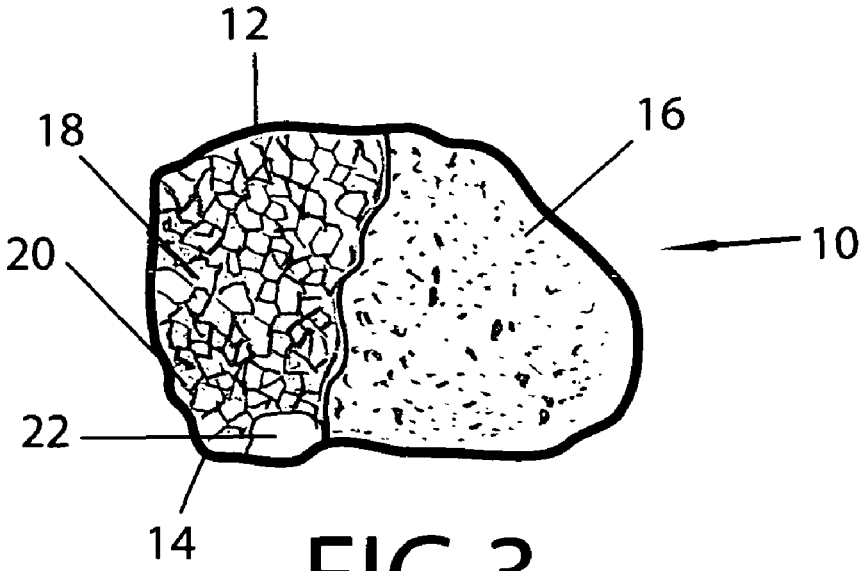
FIG. 3 is an elevational side view of the artificial hollow core bolder illustrating partially the hole in the chicken wire and the stucco on the filled and chicken wire wrapped plastic bag.

A hole 22 is cut in the chicken wire 20, at the bottom 14 of the boulder 10 illustrated in FIG. 3. Stucco mix 16 is troweled over the chicken wire 20, except where the hole 22 is. As described in Step 6 of FIG. 5 the chicken wire 20 is lightly pulled away from the plastic so it is in the middle of the stucco layer. After the first layer of stucco has dried a second layer of stucco is troweled on as described in Step 7 of FIG. 5. If desired, a stucco coloring agent and strengthening fiberglass strands can be mixed in the second stucco layer before application.

Figure 4:
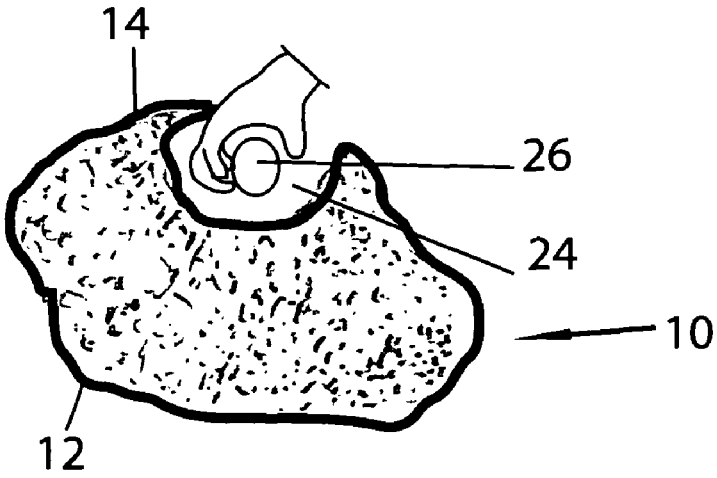
FIG. 4 is a perspective side view of the artificial boulder, which has been inverted and illustrating the boulder being filled with expended cans.

The boulder 10, illustrated in FIG. 4, is inverted and a hole 24 is cut in the plastic bag 18, through the hole in the chicken wire 20 at the bottom 14 of the boulder. The newspapers are now removed through the hole 24. The hollow boulder can now be filled with expended cans 26, or other non-organic, non-biodegradable waste, such as including but not limited to, expended plastic bottles or empty plastic grocery bags (not shown). The hole 24 is then sealed with chicken wire 18 and stucco 16. The completed boulder 10 of FIG. 1 is then sealed with a penetrating acid stain or environmentally friendly latex stain, as described in step 11 of FIG. 5.

FIG. 5 shows the steps of the method of producing the artificial hollow core boulders of the present invention comprising:

Step 1: A plastic trash bag is loosely filled with crumpled newspaper and tied shut. The trash bag can be any standard size, including but not limited to; 13 gallon, 30 gallon, 33 gallon, or one gallon, depending on the size of the boulder or rock desired. The bag is not packed tightly, so that it can remain malleable.

Step 2: The newspaper filled bag of step 1 is wrapped with a layer of chicken wire as shown in FIG. 2.

Step 3: Various parts of the chicken wire wrapped bag of step 2 are pressed by hand to mold the bag into a boulder shape. Since the bag is malleable it can be hand shaped to simulate a desired rock or boulder shape, such as the boulder shape illustrated in FIG. 1.

Step 4: A hole approximately 5" by 5" is cut in the chicken wire at the bottom of the chicken wire wrapped, boulder shaped bag. This hole is illustrated in FIG. 3. The hole may be smaller or larger than 5" by 5" depending upon the size of the plastic trash bag used.

Step 5: Wet stucco mix is troweled over the chicken wire, except where the hole in the chicken wire has been cut.

Step 6: Immediately the chicken wire is lightly pulled away from the plastic, so that the wire is in the middle of the stucco layer.

Step 7: After the stucco has dried, a second layer of stucco is troweled over the first layer. If desired, a coloring agent is added to the stucco mix. Also, if desired, fiberglass strands can be added to the second stucco layer before application.

Step 8: Now the rock or boulder is inverted and a hole is cut in the plastic bag where the hole in the chicken wire is at the bottom of the boulder or rock, and the newspapers are removed.

Step 9: The hollow boulder is now filled with expended, crushed cans and plastic bottles. If a lighter product is desired, the boulder or rock may be left hollow. Or, if a lighter product is desired, but recycling still wanted, the boulder or rock can be filled with expended, plastic grocery bags.

Step 10: The hole is then sealed with chicken wire and stucco.

Step 11: The completed boulder as illustrated in FIG. 1 is now sealed with a penetrating acid stain or environmentally friendly latex stain.

It is to be understood that the present invention is not limited to the embodiments described above. Since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of making an artificial hollow core boulder or rock comprising:

(a) filling a plastic trash bag with a material selected from the group consisting of newspaper, hay, used sponges, used rags, used foam, and cut-up pillows, and tying the bag shut;

(b) wrapping the filled plastic trash bag with chicken wire;

(c) pressing the chicken wire by means of hands to form a boulder or rock shape;

(d) cutting a hole in the chicken wire;

(e) coating the chicken wire with a first layer of stucco and allowing the first stucco layer to dry;

(f) coating the dried first stucco layer with a second layer of stucco;

(g) cutting a hole in the plastic bag where the hole in the chicken wire was cut;

(h) removing the newspaper, hay, used sponges, used rags, used foam, or cut-up pillows, through said hole in the plastic bag;

(i) filling the bag through said hole in the plastic bag with materials selected from the group consisting of expended crushed cans, expended plastic bottles, and expended plastic bags;

(j) sealing said hole in the chicken wire and said hole in the plastic bag with chicken wire and stucco; and (k) sealing the stucco surface with acid or latex stain.

2. The method as of claim 1, wherein a coloring pigment is mixed into the second layer of wet stucco.

* * * * *